US005950934A

United States Patent [19]

Podesta et al.

[11] Patent Number: 5,950,934

[45] Date of Patent: Sep. 14, 1999

[54] CEMENT MIXER SAND SPREADER

[76] Inventors: Robert J. Podesta, 955 Northfield Rd., Woodmere, N.Y. 11598; Alexander Cicciari, 249 Bronte Trace, Virginia Beach, Va. 23462

[21] Appl. No.: 09/040,493

[22] Filed: Mar. 18, 1998

[51] Int. Cl.[6] ..... E01C 19/20

[52] U.S. Cl. ..... 239/663; 239/650; 239/681

[58] Field of Search ..... 239/651, 657, 239/663, 668, 670, 681, 687, 650

[56] References Cited

U.S. PATENT DOCUMENTS

| | | | |
|---|---|---|---|
| 3,402,895 | 9/1968 | Spellman | 198/139 |
| 3,610,539 | 10/1971 | van der Lely | 239/657 |
| 4,442,979 | 4/1984 | Kupper | 239/656 |
| 4,491,275 | 1/1985 | Holsworth | 239/663 |
| 4,757,918 | 7/1988 | Ottewel | 222/139 |
| 5,067,818 | 11/1991 | Howe | 366/46 |

*Primary Examiner*—Andres Kashnikow
*Assistant Examiner*—David Deal
*Attorney, Agent, or Firm*—Malcolm J. Chisholm, Jr.

[57] ABSTRACT

The invention is a cement mixer sand spreader for applying a sand mixture to a roadway to enhance friction for motorized traffic passing over the roadway and to simultaneously lower a freezing temperature of the ice and/or snow on the roadway. One form of the invention includes two major components. The first is a self-propelled cement mixer vehicle having a powered barrel for rotatably storing the sand mixture, wherein the barrel defines a discharge outlet for discharging the sand mixture upon rotation of the barrel in a discharge direction. The second is a sand spreader having a hopper secured adjacent the discharge outlet of the cement mixer for receiving the sand mixture discharged out of the barrel, the sand spreader also having a powered spinner plate rotatably secured adjacent a discharge end of the hopper for spreading the sand mixture over a roadway whenever the sand mixture passes through the hopper and contacts the rotating spinner plate. In other forms of the invention, the cement mixer sand spreader also includes a drop chute positioned between the hopper and spinner plate, wherein the drop chute is detachable from the hopper to facilitate securing the sand spreader to the cement mixer. The drop chute may also include a mounting post dimensioned to slide into a standard pinnacle mount on known cement mixers, which pinnacle mount supports standard cement flow chutes secured to known cement mixers.

12 Claims, 4 Drawing Sheets

CEMENT MIXER SAND SPREADER

BACKGROUND OF THE INVENTION

The present invention relates to sand spreaders for applying a snow and/or ice melting mixture of abrasives such as sand and various salts to roadways, and especially relates to motorized, self-propelled sand spreaders.

In Northern climates where safe transportation upon roadways is threatened during periods of ice and/or snow accumulation, it is well-known to use self-propelled sand spreaders to apply a coating of abrasives to the roadway. Such abrasives typically increase friction for motorized traffic passing over the ice and/or snow covered roadway, and simultaneously lower the freezing temperature of the ice or snow in contact with the abrasives. The abrasives usually include a base of sand particles or a similar flowable substance along with various concentrations of salts in either granular or flake-like formations, or occasionally the abrasives will be exclusively a salt or similar chemical. For convenience of description, such abrasives will hereafter be referred to as a sand mixture.

The sand mixture is typically poured by a large bucket loader into a hopper of a "spreader" affixed to a large truck body. Frequently the spreader is mechanically secured within a body of a traditional dump truck, or the spreader may be directly attached to a chassis of the truck. Such spreaders are usually elongate funnel shaped structures of a well-known overall design having a powered conveyer belt at the apex of the funnel, wherein the conveyor belt moves in an endless loop in a direction parallel to an axis of motion of the truck during spreading of the sand mixture. The funnel shaped walls serve to direct the sand mixture onto the conveyor belt, and the conveyor belt moves the sand mixture toward a back end of the spreader into a discharge chute. The chute directs the sand onto a rotating spinner assembly that broadcasts the sand over the roadway behind truck in a well-know manner as the truck moves forward. More modern spreaders frequently include liquid injectors that include placement of a tank on or near the spreader and a powered distribution assembly that injects the liquid onto the roadway with the sand mixture.

Known sand mixture spreaders are therefore complex, including many costly moving parts that necessarily result in an array of problems. For example, the conveyor belt assemblies of known sand spreaders are typically driven by expensive, complex hydraulic motors and pumps, or separate, small internal combustion motors and related multiple bearing and axle assemblies that require constant maintenance where they are exposed to abrasive, high salt concentration environments. The belts are known to bind up and stall if large, rock-sized pieces of the sand-mixture wedge between the belts and outlets to spinner assemblies. Also, know spreaders using conveyor belt assemblies typically include reduction gear boxes an associated chains and sprocket gears. Therefore, great care must be taken to insure that consistent sized-particles of sand are placed in such spreaders.

Additionally, such conveyor belt types of spreaders operate at maximum efficiency through only a narrow range of belt speeds, while the truck carrying the spreader ordinarily operates at a wide range of road speeds, especially where the truck operates in an urban or suburban environment. Consequently, flow rate of sand discharged off of the spinner assembly onto the roadway is typically set by a truck operator prior to application of the sand mixture to the roadway by adjusting mechanical deflectors within the distribution chute between a wide open position to a barely open position, depending upon the intended route of the spreader and the particular snow/ice conditions on the roadway. Therefore, efficient application of the sand mixture and best usage of the time of the operator is compromised because of inherent structural limitations of such common, known spreaders.

A further cost and time constraint of known spreaders is associated with securing such a spreader in a dump truck body or onto a truck chassis. The spreaders are very heavy and are frequently raised onto costly, complex support racks, under which the truck is positioned. The spreaders are then lowered onto the truck and mechanically secured such as by chains, etc. The truck must be further modified by having well-known power take off hydraulic lines or mechanical shafts directed to operating and/or control systems of the spreaders, and by having control apparatus secured within reach of the operator within the truck. As is apparent, when such a spreader is secured to a large dump truck, the truck cannot be used for alternative tasks requiring usage of its dump body until the spreader is removed, requiring further labor and time expenses.

An additional limitation of known spreaders is that they are incapable of mixing abrasives together. For example, granular or flaked salt chemicals must be mixed with a base of sand for even distribution upon the roadway to maximize the capacity of the sand mixture to enhance friction and melting of the snow and/or ice on the roadway. Typically such mixing is performed at a storage site for the sand mixture, and the mixture is then loaded into the spreader. Once mixed, however, the sand mixture must be stored under a roof, because rain water or melting snow could melt the salt chemicals causing them to run out of the mixture thereby depleting the value of the sand mixture and often rendering the melted chemicals an environmental hazard. Consequently, large storage barns must be constructed at such sand mixture loading sites to protect the sand mixture from rain or snow, at great cost and loss of the barn area of the site for alternative usage.

During periods of time that known sand spreaders are utilized to treat roadways, known "transit" or cement mixers are typically idle, because construction activities requiring pouring of cement from cement mixers are usually stopped during snow and/or ice storms. Self-propelled cement mixers of the type having a large powered barrel for rotatably storing, mixing and rear or front discharge of a sand-cement mixture are not known to have been used to distribute a sand mixture to roadways to enhance friction and/or lower the freezing temperature of snow and/or ice on the roadway.

Accordingly, it is a general object of the present invention to provide a cement mixer sand spreader that overcomes the problems of known sand spreaders.

It is a more specific object to provide a cement mixer sand spreader that minimizes modifications to a cement mixer vehicle to permit the vehicle to apply a sand mixture to a snow and/or ice covered roadway.

It is another specific object to provide a cement mixer sand spreader that enables an operator of the cement mixer sand spreader to readily adjust rates of discharge of a sand mixture out of the spreader while the spreader is spreading a sand mixture.

It is yet another object to provide a cement mixer sand spreader that enables mixing of a sand and salt chemical within the spreader while the spreader is operating thereby obviating any pre-mixing of chemicals making up the sand mixture.

These and other objects and advantages of this invention will become more readily apparent when the following description is read in conjunction with the accompanying drawings.

SUMMARY OF THE INVENTION

A cement mixer sand spreader is disclosed for applying a sand mixture to a roadway to enhance friction for motorized traffic passing over the roadway and to simultaneously lower a freezing temperature of the ice and/or snow on the roadway. In a particular embodiment, the cement mixer sand spreader includes a self-propelled cement mixer vehicle having a powered barrel for rotatably storing the sand mixture, wherein the barrel defines a discharge outlet for discharging the sand mixture upon rotation of the barrel in a discharge direction, and a sand spreader having a hopper secured adjacent the discharge outlet of the cement mixer for receiving the sand mixture discharged out of the barrel, the sand spreader also having a powered spinner plate rotatably secured adjacent a discharge end of the hopper for spreading the sand mixture over a roadway whenever the sand mixture passes through the hopper and contacts the rotating spinner plate.

In an alternative embodiment, the cement mixer sand spreader also includes a drop chute positioned between the hopper and spinner plate, wherein the drop chute is detachable from the hopper to facilitate securing the sand spreader to the cement mixer. The drop chute may also include a mounting post dimensioned to slide into a standard pinnacle mount on known cement mixers, which pinnacle mount supports standard cement flow chutes secured to known cement mixers. Additionally, the drop chute and hopper may include a height adjustment mechanism to compensate for differences in distance between pinnacle mounts and discharge outlets on different style cement mixers.

In use of a preferred embodiment of the cement mixer sand spreader of the present invention, first the cement flow chute is removed from the pinnacle mount of a standard cement mixer. Next the hopper of the sand spreader is positioned to nest under standard funnel-shaped guide blades adjacent the discharge outlet of the barrel, and the mounting post of the drop chute slides into and is secured in the pinnacle mount. Then the hopper is permitted to move downward a slight distance so that a discharge end of the hopper enters the drop chute to secure the hopper within the drop chute. Standard hydraulic lines are secured from a hydraulic motor that spins the spinner plate secured adjacent a discharge end of the drop chute to a hydraulic control system within the cement mixer. The cement mixer sand spreader may then be filled with an appropriate sand mix, or with unmixed sand and appropriate chemicals in a standard manner through a flow inlet of the barrel. The barrel may then be rotated by the operator in a standard manner in a mixing direction to mix the chemicals and sand. Then, when the cement mixer sand spreader is in a position to apply the sand mixture, the operator simply activates the hydraulic control system to initiate rotation of the spinner plate, and then changes the direction of rotation of the barrel to an opposite discharge direction so that the sand mixture pours out of the discharge outlet of the barrel and through the hopper and drop chute onto the spinner plate to be broadcast over the roadway. By adjusting a speed of rotation of the barrel, the operator may readily and efficiently control a rate of discharge of the sand mix onto the roadway to appropriately match the discharge rate with a traveling speed of the vehicle and existing snow and/or ice conditions on the roadway.

DESCRIPTION OF THE PREFERRED EMBODIMENTS

Figure 1:
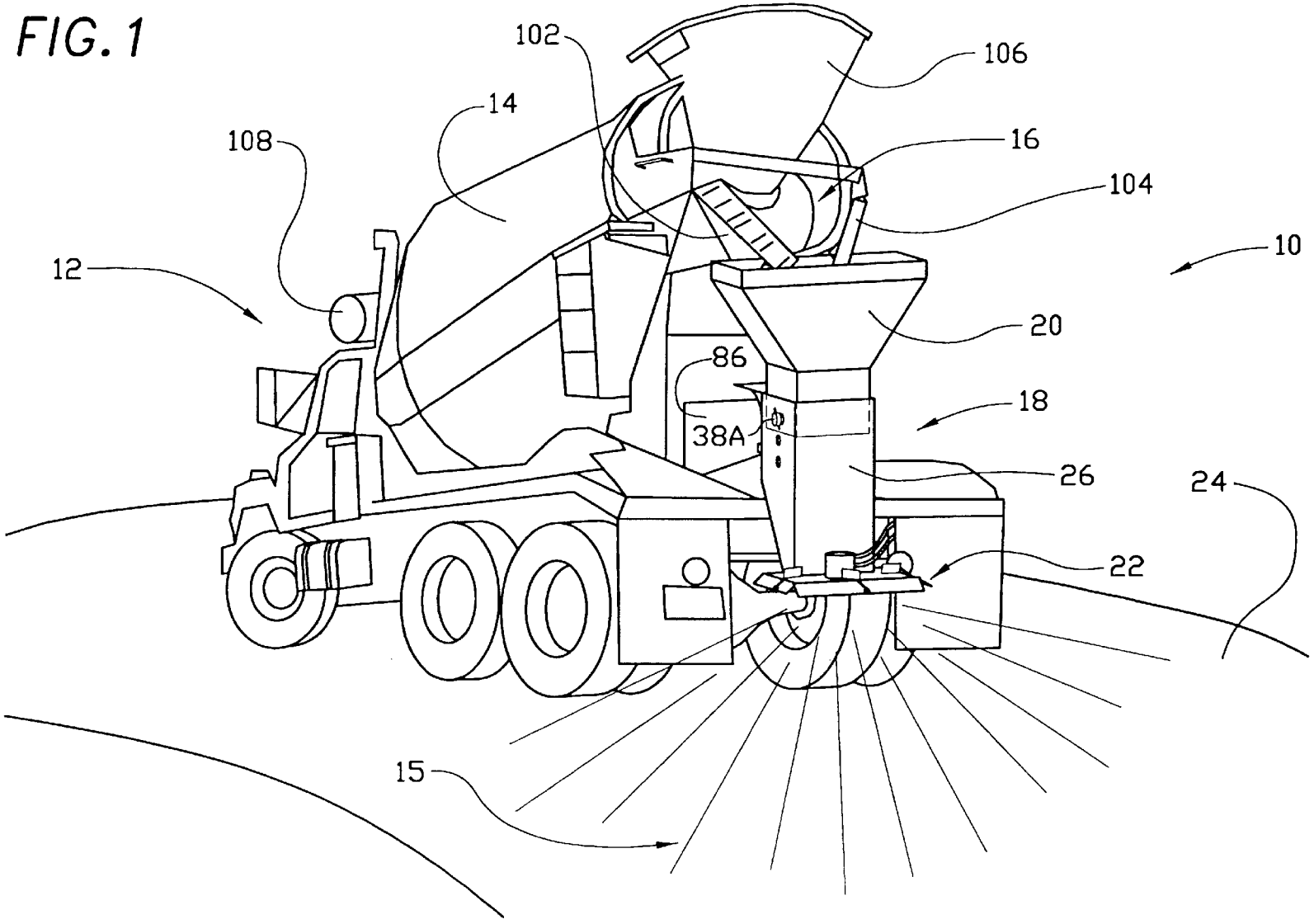
FIG. 1 is perspective view of a cement mixer sand spreader constructed in accordance with the present invention.

Referring to the drawings in detail, a cement mixer sand spreader of the present invention is best shown in FIG. 1, and is generally designated by the reference numeral 10. The cement mixer sand spreader 10 includes a self-propelled cement mixer vehicle 12 of a type well-known in the art having a powered mixing barrel 14 for rotatably storing a sand mixture 15, wherein the barrel 14 defines a discharge outlet 16 for discharging the sand mixture 15 upon rotation of the mixing barrel 14 in a discharge direction; and, a sand spreader 18 having a hopper 20 secured adjacent the discharge outlet 16 for receiving the sand mixture 15 discharged out of the outlet 16, and having a powered spinner plate assembly 22 below the hopper for spreading the sand mixture 15 over a roadway 24 whenever the sand mixture passes through the hopper 20 and contacts the spinner plate assembly 22.

Figure 2:
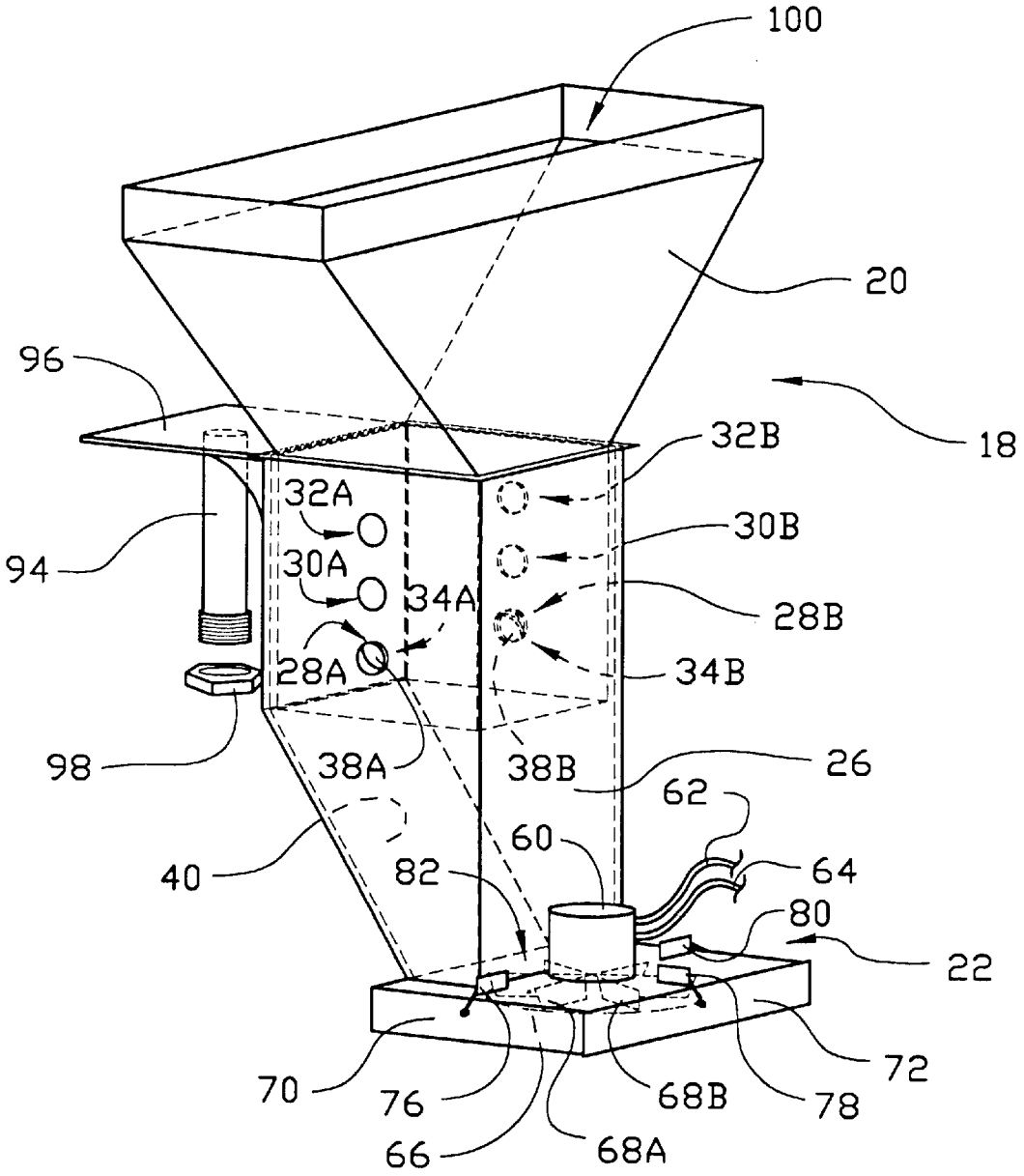
FIG. 2 is a perspective view of a sand spreader of the present invention detached from the FIG. 1 cement mixer.
Figure 3:
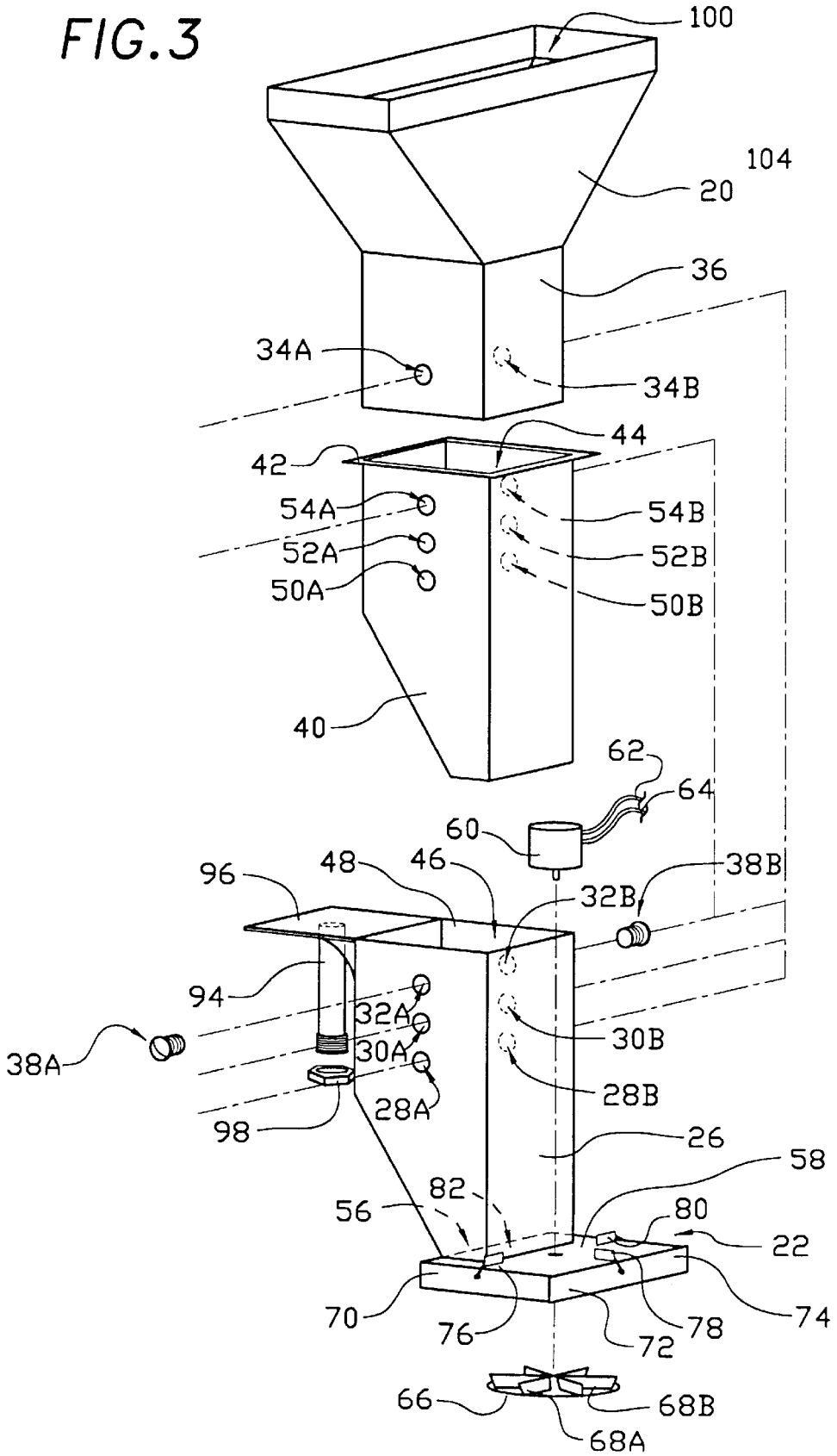
FIG. 3 is an exploded perspective view of the FIG. 2 sand spreader.

As best shown in FIGS. 2 and 3, the sand spreader 18 may include a drop chute 26 between the hopper 20 and the spinner plate assembly 22. The drop chute 26 and the hopper 22 may cooperate to define a height adjustment means for adjusting a distance between the spinner plate assembly 22 and the hopper 20, such as a first pair of chute adjustment holes 28A, 28B, a second pair of chute adjustment holes 30A, 30B, and a third pair of chute adjustment holes 32A, 32B defined within the drop chute 26 that correspond with a pair of hopper securing holes 34A, 34B defined within a hopper extension 36. To adjust the distance between the hopper and the spinner plate assembly 22, the hopper securing holes 34A, 34B may simply be positioned adjacent either the first 28A, 28B, second 30A, 30B or third 32A, 32B chute adjustment holes and then the adjustment holes 34A, 34B are secured adjacent the selected first, second or third pair of chute adjustment holes by a pair of securing bolts 38A, 38B, as shown in FIG. 2 wherein the hopper securing holes 34A, 34B are secured adjacent the first pair of chute adjustment hole 28A, 28B to minimize a distance between the hopper 20 and the spinner plate assembly 22. The height adjustment means may also include any of a variety of well-known structures for adjustably securing a cylinder or chute-like structure within a sleeve-like structure of roughly corresponding dimensions, such as clevis pins with a cotter pin or a spring-biased lock pin, etc.

As shown in FIG. 3, the sand spreader 18 may also include a wear sleeve 40 dimensioned to nest within the drop chute 26 to minimize wear on material making up the drop chute 26. In preferred embodiments, the drop chute 26 and attached spinner plate assembly are made of structural metals well-know in the field such as steel alloys of adequate mechanical strength to withstand the loads associated with ordinary spreading of a sand mixture, such as are commonly used in known spreaders affixed to large dump trucks as described hereinabove. The wear sleeve 40 would be made of a light, inexpensive plastic material such as modern, well-known polymers commonly used in wheel barrels and snow shovels, so that the more expensive metals making up the drop chute 26 are protected from abrasive wear and from excessive salt and/or related chemical exposure of the sand mixture passing through the drop chute 26 to the spinner plate assembly 22. The hopper 20 and hopper extension 36 may be made of the same metals as the drop chute 26, or may be made of a single piece of plastic of similar construction as the wear sleeve 40, as described in more detail hereinbelow.

As best seen in FIG. 3, the wear sleeve 40 includes a mounting shoulder 42 surrounding a wear sleeve inlet 44. The mounting shoulder 42 is dimensioned to correspond to a circumference of a drop chute inlet 46 so that the shoulder 42 rests on an inlet edge 48 of the drop chute to secure the wear sleeve 40 in a fixed position within the drop chute 26. The wear sleeve also includes a first pair of sleeve adjustment holes 50A, 50B, a second pair of sleeve adjustment holes 52A, 52B, and a third pair of sleeve adjustment holes 54A, 54B that correspond to the first 28A, 28B, second 30A, 30B or third 32A, 32B chute adjustment holes to facilitate the height adjustment means in varying a distance between the hopper 20 and the spinner plate assembly 22.

The spinner plate assembly 22 may be any of a variety of common spinner plate assembly means for rotatably spreading the sand 15 mixture over the roadway 24 well-known in the art, including an electrically, hydraulically or mechanically rotated plate-like structure, with or without impact blades that may have no or a plurality of adjustable mechanical baffles surrounding the plate-like structure, which spinner plate assembly means is positioned adjacent an outlet 56 of the drop chute 26 or hopper 20. As shown best in FIG. 3, the spinner plate assembly 22 may include a frame 58 secured to the drop chute outlet 56 that supports an hydraulic motor 60 served by inlet 62 and outlet 64 hydraulic lines to rotate a spinner plate 66 secured below the frame 58 in a well-known manner. The spinner plate may include a plurality of impact blades 68A, 68B that serve to rotationally impact particles of the sand mixture 15 as the plate 66 rotates to assist in spreading the mixture over the roadway. The frame 58 may also support in a hinged relationship a plurality of guide baffles, such as first guide baffle 70, second guide baffle 72, and third guide baffle 74 shown best in FIG. 3. Each guide baffle includes a hinge latch extending between the baffle and the frame in a well-known manner, such as first hinge latch 76 secured to the first guide baffle 70, second hinge latch 78 secured to the second guide baffle 72 and third hinge latch 80 secured to the third guide baffle 74. The hinge latches 76, 78, and 80 enable adjustment of the first, second and/or third guide baffles between a closed position (shown in FIG. 3) and an open position (shown in FIG. 1) so that an operator of the cement mixer sand spreader 10 may selectively set the hinge latches to spread sand to either side or the back the cement mixer vehicle. The frame 58 of the spinner plate assembly 22 defines a spinner assembly inlet 82 over the spinner plate 66 that is dimensioned to engage the drop chute outlet 56 so that the sand mixture 15 passing through the hopper 20 and drop chute 26 may flow through the spinner assembly inlet 82 directly onto the spinner plate 66.

Figure 4:
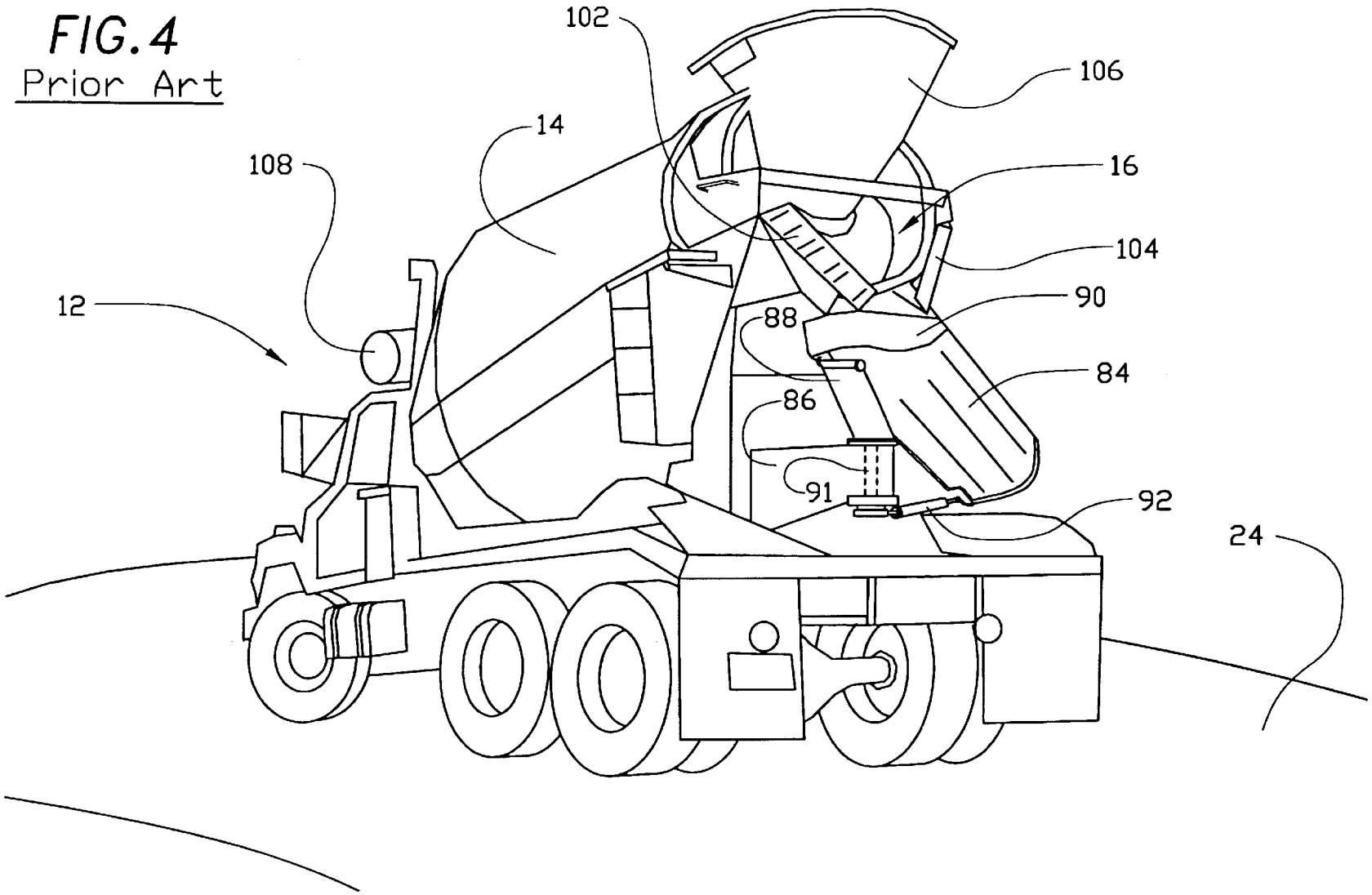
FIG. 4 Prior Art
FIG. 4 is a perspective view of a standard, self propelled cement mixer well-known in the art, showing a pinnacle mount that supports a cement flow chute.

The sand spreader 18 readily secures to the standard, self-propelled cement mixer 12. As best shown in FIG. 4, the self-propelled cement mixer 12 includes a flow chute 84 that is secured to the mixer 12 by a well-known pinnacle mount 86 extending below the discharge outlet 16 of the mixing barrel 14. The flow chute 84 includes a mount brace 88 secured to a receiver 90 of the chute 84 that extends into a securing bore 91 of the pinnacle mount 86 and supports the chute 84 so that it can receive and distribute a cement mixture flowing out of the discharge outlet 16. As is well-known, common cement mixers include a plurality of flow chute extensions (not shown) that secure to the flow chute 84 for distributing the cement mixture further from the mixer 12. A pivot brace 92 also extends from the pinnacle mount 86 to the flow chute 84 to assist an operator (not shown) in pivoting the flow chute 84 in a well-known manner for distributing the cement mixture to varying destinations behind the cement mixer 12. In servicing and/or cleaning the flow chute 84, the mount brace 88 is removed from the securing bore 91 and the pivot brace 92 is detached from the pinnacle mount 86, so that the securing bore 91 of the pinnacle mount 86 is empty.

As best seen in FIGS. 2 and 3, the sand spreader 18 includes a mounting means for securing the hopper below the discharge outlet 16 of the mixing barrel 14 of the cement mixer 12, such as a mounting post 94 secured to a mount plate 96 which is secured to the hopper 22, hopper extension 36, or as shown in FIGS. 2 and 3, to the drop chute 26, wherein the mounting post 94 is dimensioned to slide into and be secured within the securing bore 91 of the pinnacle mount 86. It is stressed that servicing and/or replacement of a flow chute 84 is common due to wear and/or damage during usage of such chutes. Therefore replacement chutes and associated braces are common and they share known structural characteristics for securing such chutes to a cement mixer 12, whether-or-not the cement mixer is a rear discharge type such as that described herein and show at FIGS. 1 and 4, or a front discharge type (not shown), wherein a discharge outlet of a powered mixing barrel is positioned at a front of the vehicle, roughly over the steering wheels. For both front and rear types of known cement mixers, cement mixture flow chutes are readily removable. The mounting means for securing the hopper 20 of the sand spreader 18 below the discharge outlet 16 includes all common mounting structures for securing flow chutes of front and rear discharge cement mixers below their respective discharge outlets, such as the described mounting post 94 and mounting plate 96. The mounting post 94 may be dimensioned to pass completely through the securing bore 91 of the pinnacle mount 86 so that a standard threaded nut 98 may secure the post 94 within the pinnacle mount 86. The mounting means may also include a variety of alternative securing structures, such as a mounting post that detachably secures to the mounting plate 96 so that, after the mounting plate is positioned over the pinnacle mount 86, the mounting post 94 passes through the mounting plate 96 and adjacent securing bore 91 of the pinnacle mount 86 to secure the plate 96 to the pinnacle mount 86. Such a detachable mounting post would be especially appropriate for a single piece sand spreader embodiment having no detachable drop chute 26 between the hopper 20 and the spinner plate assembly 22, wherein the mounting plate 96 would be attached directly to the hopper 20 or hopper extension 36. Additional mounting means may include common structures appropriate for securing the hopper 22 or hopper extension 36 below discharge outlets of cement mixers that do not use pinnacle mounts for supporting their cement flow chutes, such as standard bolts and nuts, cotter pins, clevis pins, common mounting structures secured to flow chutes affixed to front discharge cement mixers (not shown) that do not use a securing bore 91 within a pinnacle mount 86, etc.

As best seen in FIGS. 1 and 4, the hopper 20 defines a hopper inlet 100 that is dimensioned to receive a lower portion of a first guide blade 102 and a lower portion of a second guide blade 104, which guide blades are positioned on the cement mixer 12 adjacent the discharge outlet 16 of the mixer barrel 14 to guide a mixture being discharged out of the outlet 16. By structuring the hopper 20 to permit lower portions of funnel-shaped cement mixer guide blades such as the first and second guide blades 102, 104 to nest within the hopper 20, the hopper is further secured to the cement mixer 12 against accidental dislodging, and any sand mixture being discharged out of the discharge outlet 16 of the mixer barrel is guided within the hopper to maximize efficient distribution of the sand mixture.

In use of the embodiment of the cement mixer sand spreader 10 shown in FIGS. 1–3 during weather requiring application of a sand mixture 15 to a roadway 24, first the mount brace 88, pivot brace 92 and attached flow chute 84 are removed from the pinnacle mount 86 of the cement mixer vehicle 12. Next, the hopper 20 of the sand spreader is supported to nest as much of the first and second guide blades 102, 104 as possible by pushing the hopper 20 up against the blades 102, 104. Then the wear sleeve 40 is positioned within the drop chute 26, and the drop chute is positioned so that the mounting post 94 slides through and is secured within the securing bore 91 of the pinnacle mount 86 by the threaded nut 98 or similar means. Next, the hopper 20 is moved downward so that the hopper extension 36 extends into the drop chute 26, and the hopper securing holes 34A, 34B are positioned adjacent either the first 28A, 28B, second 30A, 30B, or third 32A, 32B chute adjustment holes so that a portion of the first and second guide blades 102, 104 remain within the hopper 20. Then, the pair of securing bolts 38A, 38B pass through the aligned drop chute holes, sleeve adjustment holes and hopper securing holes 34A, 34B, as shown in FIG. 1. Then the inlet and outlet hydraulic lines 62, 64 are secured to a standard hydraulic control assembly (not shown) of a type well-known for control of prior art spin plate assemblies so that the operator (not shown) may selectively rotate the spinner plate 66.

The cement mixer sand spreader 10 is then ready to have a sand mixture 15, or combination of separate loads of an abrasive and related chemicals, poured through a standard barrel inlet 106 of the cement mixer. It is understood that the sand mixture, etc. could be loaded prior to securing the sand spreader 18 to the cement mixer vehicle 12, and that loading would take place through standard gravity-based flow apparatus common at all cement mixing yards. In the event a liquid salt solution or related liquid chemical commonly used for treating snow and/or ice-covered roadways is needed to be applied to the sand mixture, such a solution may be readily stored in a mixer water tank 108 found on virtually all concrete mixer vehicles for adding water to a sand cement mixture. A liquid bypass means for dispersing such a liquid adjacent the spin plate assembly 22 connects the liquid in the mixer water tank to a dispersion nozzle (not shown) of a powered distribution assembly adjacent the spin plate assembly 22 in the same manner as prior art liquid solution dispersion apparatus on known sand spreaders attached to large dump trucks, as described above.

Because the cement mixer sand spreader 10 of the present invention can be readily secured to an existing cement mixer vehicle 12 without adding a separate sand mixture carrying apparatus, the cement mixer sand spreader 10 may be prepared for dispatch to treat roadways more rapidly than known large sand spreaders that must be secured within a dump truck body prior to loading. Additionally, the cement mixer sand spreader may contain a greater load capacity than dump-truck vehicles of comparable gross vehicle weight because of the inherent efficiency of a mixing barrel compared to an elongate funnel shaped sand spreader secured to a large dump truck bed. Moreover, because a cement mixer vehicle 12 ordinarily includes control apparatus for rotating the barrel in both a mixing direction and an opposed discharge direction, wherein internal, cork-screw shaped vanes both mix and discharge a contained mixture in a well-known manner, an operator may efficiently control initiation and cessation of sand mixture discharge as well as rates of discharge with far greater sensitivity than known control apparatus on prior art large sand spreaders.

It is well-known than during major snow storm events, utilization of all possible snow removal equipment is a crucial factor in ensuring a safe living environment, and simultaneously during such events, virtually all cement mixer vehicles within the affected area are idle. The cement mixer sand spreader 10 of the present invention will dramatically increase snow removal capacity at a modest cost compared to increasing available numbers of known large sand spreaders based upon large dump trucks. Further cost savings will be obtained because existing cement yards or plants that support self-propelled cement mixers invariably include all necessary equipment for loading the cement mixers with a sand mixture. Finally, in regions that do not traditionally receive substantial snow fall amounts, such as the South-central and Southeastern regions of North America, efficient snow removal and ice control on roadways once or twice every few years is virtually impossible because of prohibitive costs of large, prior art sand spreaders mounted on large dump trucks. However, such regions have an ample supply of standard cement mixer vehicles. The present cement mixer sand spreader 10 will dramatically enhance snow removal and ice control capacities of such regions at a modest cost.

While the present invention has been described and illustrated with respect to a particular construction of a cement mixer sand spreader 10, it will be understood by those skilled in the art that the present invention is not limited to the described and illustrated examples. In particular it is stressed that the cement mixer sand spreader includes a hopper and mounting means appropriate for a cement mixer vehicle having a mixing barrel discharge outlet at a front or forward end of the vehicle approximately over the steering wheels, wherein the sand spreader may include a hopper extension or drop chute having an angular disposition so that the hopper extension or drop chute and spinner plate assembly secured thereto do not obstruct visibility of the vehicle operator, but instead the hopper extension or drop chute descend downward adjacent a forward corner or side of the vehicle to a spinner plate assembly mounted at a lower portion of the forward corner, side or center of the vehicle. Accordingly, reference should be made primarily to the attached claims rather than the foregoing description to determine the scope of the invention.

What is claimed is:

1. A cement mixer sand spreader for applying a sand mixture to a roadway, comprising:

a. a self-propelled cement mixer vehicle including a powered mixing barrel for rotatably storing the sand mixture wherein the barrel defines a discharge outlet for discharging the sand mixture upon rotation of the barrel in a discharge direction; and, b. a sand spreader having a hopper secured adjacent the discharge outlet for receiving the sand mixture discharged out of the discharge outlet, and having a powered spinner plate assembly means secured adjacent an outlet of the hopper for rotatably spreading the sand mixture over the roadway whenever the sand mixture passes through the hopper onto a rotating spinner plate within the assembly as the cement mixer vehicle passes over the roadway.

2. The cement mixer sand spreader of claim 1, wherein the sand spreader includes mounting means for securing the hopper adjacent the discharge outlet of the mixing barrel.

3. The cement mixer sand spreader of claim 2, wherein the mounting means includes a mounting plate secured to the hopper and a mounting post dimensioned to slide into and be secured within a securing bore of a pinnacle mount on the cement mixer vehicle below the discharge outlet and the mounting post secures to the mounting plate to secure the sand spreader to the pinnacle mount.

4. The cement mixer sand spreader of claim 1, wherein the sand spreader includes a drop chute detachably secured between the hopper and the spinner plate assembly means, and the drop chute and hopper include a height adjustment means for adjusting a distance between the hopper and the spinner plate assembly means.

5. The cement mixer sand spreader of claim 4, wherein the sand spreader includes a wear sleeve dimensioned to nest within the drop chute.

6. The cement mixer sand spreader of claim 1, wherein the hopper defines a hopper inlet dimensioned to receive a lower portion of one or more guide blades secured adjacent the discharge outlet of the mixing barrel whenever the sand spreader is secured to the cement mixer vehicle, so that the guide blades secure the hopper adjacent the outlet and guide the sand mixture into the hopper inlet.

7. A cement mixer sand spreader for applying a sand mixture to a roadway, comprising:

a. a self-propelled cement mixer vehicle including a powered mixing barrel for rotatably storing the sand mixture wherein the barrel defines a discharge outlet for discharging the sand mixture upon rotation of the barrel in a discharge direction; and, b. a sand spreader having a hopper secured adjacent the discharge outlet for receiving the sand mixture discharged out of the discharge outlet, having mounting means for securing the hopper adjacent the discharge outlet, and having a powered spinner plate assembly means secured adjacent an outlet of the hopper for rotatably spreading the sand mixture over the roadway whenever the sand mixture passes through the hopper onto a rotating spinner plate within the assembly as the cement mixer vehicle passes over the roadway.

8. The cement mixer sand spreader of claim 7, wherein the mounting means includes a mounting plate secured to the hopper and a mounting post dimensioned to slide into and be secured within a securing bore of a pinnacle mount on the cement mixer vehicle below the discharge outlet and the mounting post secures to the mounting plate to secure the sand spreader to the pinnacle mount.

9. The cement mixer sand spreader of claim 8, wherein the hopper defines a hopper inlet dimensioned to receive a lower portion of one or more guide blades secured adjacent the discharge outlet of the mixing barrel whenever the sand spreader is secured to the cement mixer vehicle, so that the guide blades secure the hopper adjacent the outlet and guide the sand mixture into the hopper inlet.

10. The cement mixer sand spreader of claim 9, wherein the sand spreader includes a drop chute detachably secured between the hopper and the spinner plate assembly means.

11. The cement mixer sand spreader of claim 10, wherein the drop chute and hopper include a height adjustment means for adjusting a distance between the hopper and the spinner plate assembly means.

12. The cement mixer sand spreader of claim 11, wherein the sand spreader includes a wear sleeve dimensioned to nest within the drop chute.

* * * * *